US005702327A

United States Patent [19]

Fullbright

[11] Patent Number: 5,702,327

[45] Date of Patent: Dec. 30, 1997

[54] APPARATUS AND METHOD FOR MARTIAL ARTS TRAINING

[76] Inventor: Marshall Fullbright, 106 Blair Mill Rd., Belton, S.C. 29627

[21] Appl. No.: 618,042

[22] Filed: Mar. 18, 1996

[51] Int. Cl.[6] ..... A63B 64/20

[52] U.S. Cl. ..... 482/83; 482/87; 473/441; 473/443

[58] Field of Search ..... 473/440, 441, 473/442, 443, 444; 482/83–90, 127, 129

[56] References Cited

U.S. PATENT DOCUMENTS 1,267,678 5/1918 McArdle .
1,703,012 2/1929 McNamara .
2,752,155 6/1956 Nedwick ..... 473/440
3,399,891 9/1968 McCormick et al. ..... 482/87
4,186,922 2/1980 Ketchum ..... 473/443
4,653,746 3/1987 Brunier .

*Primary Examiner*—Jerome Donnolly
*Attorney, Agent, or Firm*—Cort Flint; Robert R. Reed

[57] ABSTRACT

An apparatus and method for martial arts training is disclosed which includes a pair of vertically aligned dummies having free ends which are spaced apart and detached. The opposing ends of the dummies are attached through pivot assemblies to a rigid frame so that the dummies may be struck by kicking without one dummy responding to the other. In this manner, the dummies may be kicked at high speeds to develop speed and control.

24 Claims, 6 Drawing Sheets

APPARATUS AND METHOD FOR MARTIAL ARTS TRAINING

BACKGROUND OF THE INVENTION

This invention relates to apparatus for martial arts training, and more particularly to a training and exercise apparatus wherein leg and arm flexibility, speed, coordination, and control may be developed.

Various types of punching bag arrangements have been previously provided, mainly for boxing. The devices primarily include a padded punching bag which is resiliently mounted so that the bag moves when punched. For example, U.S. Pat. Nos. 4,653,746 and 1,703,012 disclose single punching bags which are mounted by means of springs for training in boxing and in the martial arts. However, the use of a single bag does not provide for adequate training and exercise for all of the actions utilized in martial arts, particularly the kicks. U.S. Pat. No. 1,267,678 discloses a practice apparatus for boxers which includes two punching bags which simulate the head and body portion of an opponent. However, the two punching bags are tied together so that some movement of each bag occurs even when a single bag is hit. While this type of arrangement may be suitable for boxing, it is not entirely suitable for all of the exercises needed in the training of martial arts, particularly high speed training.

An advertising brochure entitled Shodan® Products of Mertens Manufacturing Company of Fort Lauderdale, Fla. discloses a martial arts exercise device which comprises upper arms and lower arms which rotate three hundred and sixty degrees for use in training and exercising of the martial arts. However, instead of being a punching bag type device, the rotating arms are only rotationally mounted, and are not yieldingly mounted.

Accordingly, an object of the invention is to provide an improved training apparatus for martial arts exercises.

Another object of the invention is to provide training apparatus for martial arts which provides for high speed kicking exercises to develop kick speed, control, coordination, and endurance.

Another object of the present invention is to provide training apparatus for the martial arts which includes independent upper and lower padded dummies which may be repetitively kicked or punched at high speeds without the movement of one unit effecting movement of the other.

SUMMARY OF THE INVENTION

The above objectives are accomplished according to the present invention by providing a training apparatus for the martial arts comprising an upright stand, an upper padded dummy and a lower padded dummy. The upright stand is supported on a floor surface and has an overhead frame portion and a base frame portion. An upper pivot joint assembly connects the upper core element to the overhead frame portion of the upright stand. An upper rigid, elongated core connects the upper padded dummy to the upper pivot joint assembly for providing omni-directional movement of the upper padded dummy. A lower padded dummy is carried by the base frame portion of the upright stand. A lower rigid, elongated core element connects to the lower padded dummy. A lower pivot joint assembly connects the lower core element to the lower base frame portion for providing omni-directional movement of the lower padded dummy.

Preferably each pivot joint assembly includes a stationary anchor, a stationary support which is spaced from the stationary anchor, a round pivot plate affixed to the core element to engage support, and a resilient connector to connect between the pivot plate and the stationary anchor and bias the pivot plate against the support. The stationary anchor includes a stationary anchor plate. The stationary support includes a stationary support plate which has a central aperture. The resilient connector extends through the central aperture to connect to the pivot plate. The stationary anchor plate and the stationary support plate are preferably circular. A first connector connects to the pivot plate. A second connector connects to the stationary anchor plate. The resilient connector comprises a coil spring which is connected between the first and second connectors. The resilient connector includes a spring connected between the pivot plate and the stationary anchor.

In a alternate embodiment of the invention the pivot joint assembly becomes an air bag joint assembly. The air bag joint assembly includes a bag support member, an air bag housing affixed to the air bag support member and a bag pivot plate with one side affixed to the elongated core and an opposite side attached to the air bag housing for carrying the elongated core. The air bag housing further includes an air valve for pressurizing the air bag housing so that a predetermined rotational stiffness of the air bag housing is provided.

In the preferred embodiment, the stand includes a rigid, vertical standard, and the overhead frame portion includes an outwardly extending frame member which extends outwardly from the standard. The upper joint assembly is carried by the upper frame member. The lower base frame portion comprises a lower, outwardly extending frame member which extends outwardly from the standard. The lower joint assembly is carried by the lower frame member. A clearance space is defined between a free end of the upper padded dummy and a free end of the lower padded dummy so that the upper and lower dummies move and respond completely independently of each other.

A method of martial arts training is provided, comprising the steps of providing an upper padded dummy which is carried by a rigid frame in a manner that the upper dummy moves in omni-directional movements. The method includes a vertically aligned lower padded dummy carried by the rigid frame below the upper dummy for omni-directional movement independent of the upper dummy. The method provides for striking the upper and lower dummies in a desired sequence to develop speed and coordination. The method comprises supporting the upper and lower dummies for omni-directional movement about independent pivot assemblies where free ends of the upper and lower dummies are completely detached.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
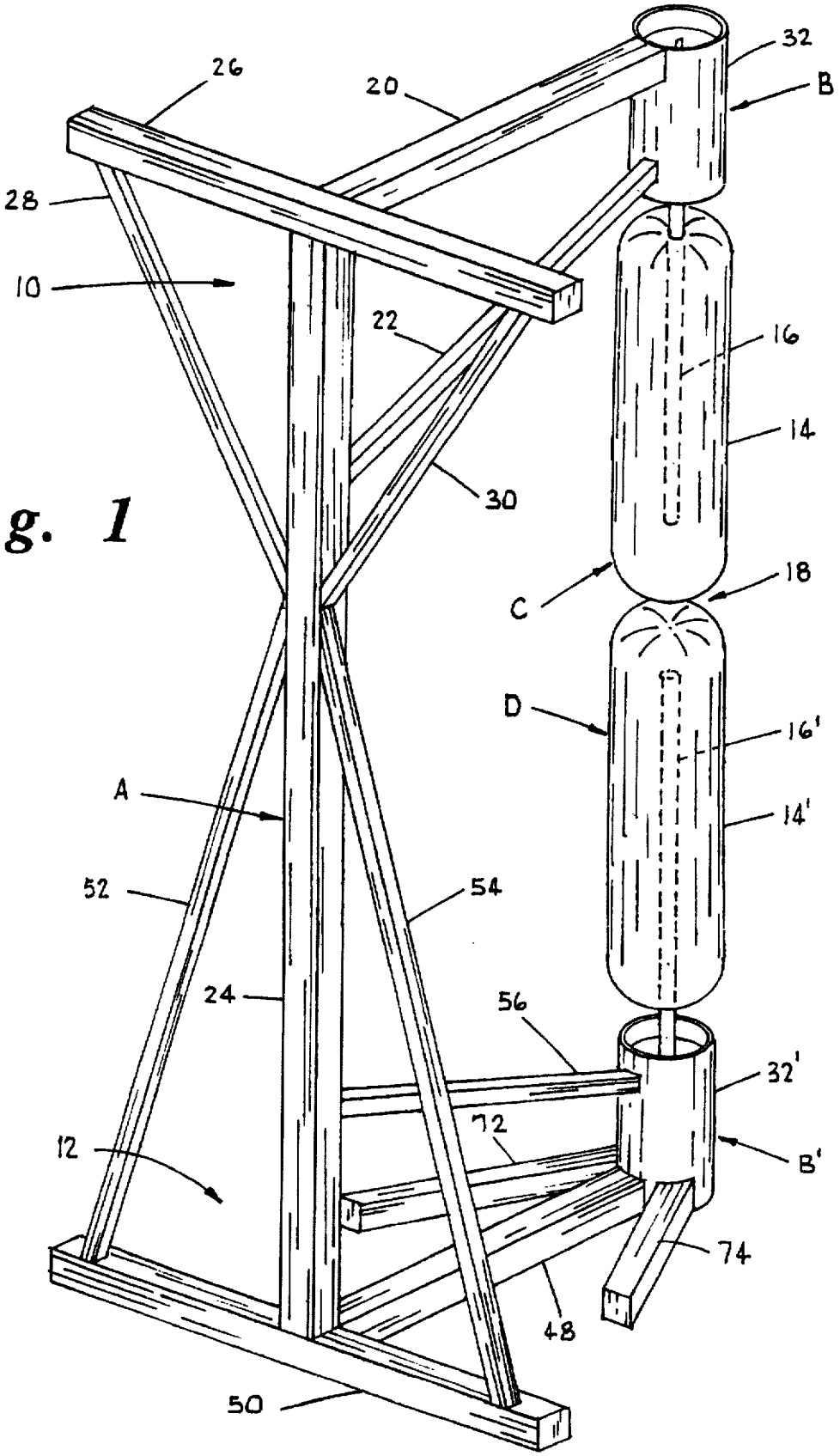
FIG. 1 is a perspective view of the martial arts training apparatus of this invention.
Figure 2:
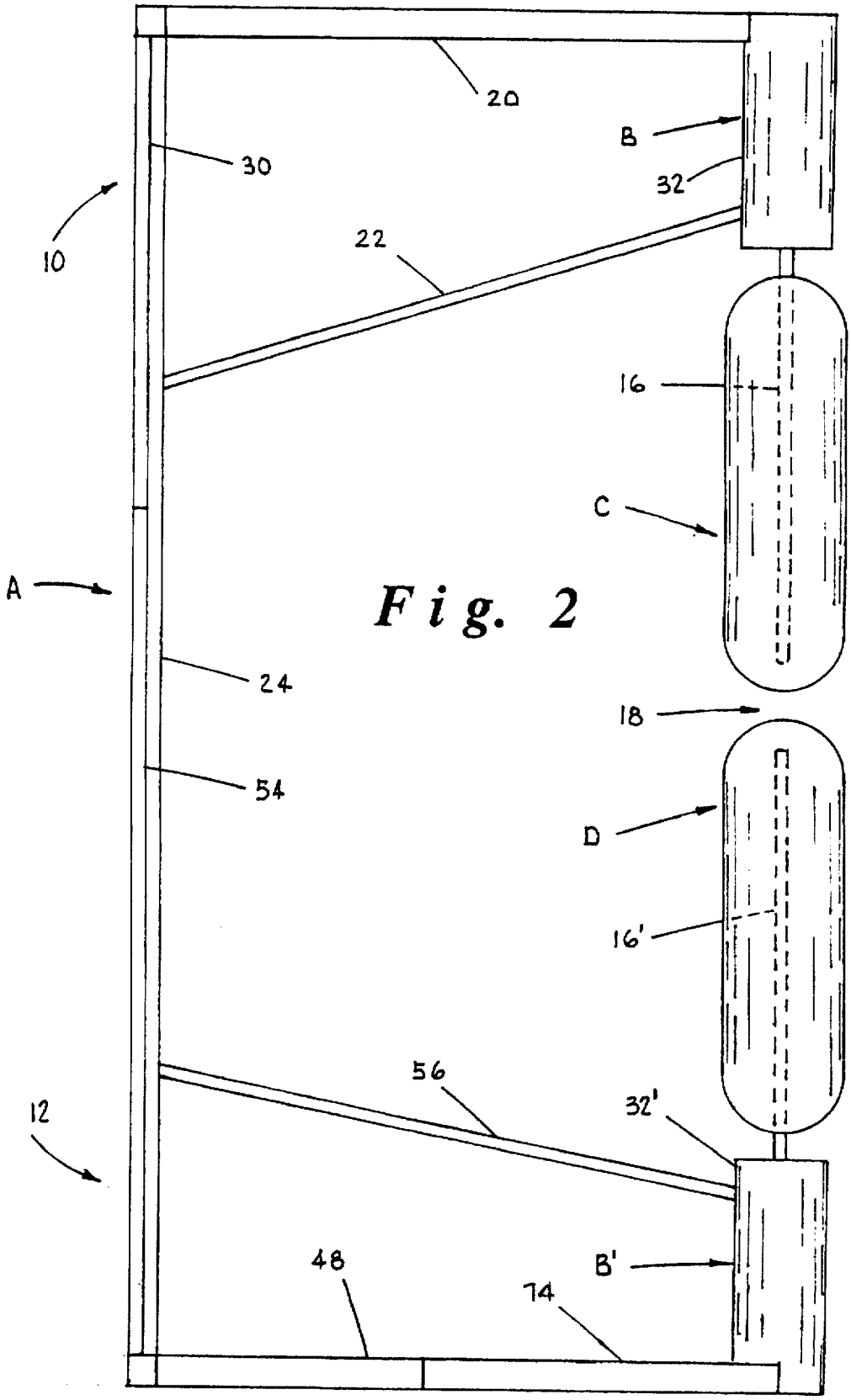
FIG. 2 is a side elevation view of the martial arts training apparatus of this invention.

Referring now in more detail to the drawings, FIG. 1 and FIG. 2 illustrate a training apparatus for the martial arts which includes an upright stand, designated generally as A, which includes an overhead frame portion 10 and a lower base portion 12. There is an upper pivot joint assembly B carried by overhead frame portion 10, and a lower pivot joint assembly B' carried by lower base portion 12. A upper padded dummy C is carried for omni-directional movement by pivot joint assembly B. A lower padded dummy D is carried for omni-directional movement by lower pivot assembly B'.

Upper padded dummy C includes a padded body 14 affixed to a central core element 16. Padded body 14 may include padding surrounded by leather, canvas, or other suitable material; or padded body 14 may include a molded neoprene bag affixed to core element 16. Likewise, lower padded dummy D includes a padded body 14' and central core 16' which may be identical to padded body 14 and central core 16 described in relation to upper padded dummy C. It will be noted that core element 16, 16' terminate short of padded body 14, 14' so as to leave a padded portion between the end of each respective core element and padded body. In addition, it will also be noted that a clearance space 18 is defined between the ends of padded body 14, 14' of the respective upper and lower dummy C, D. This ensures completely independent action so that the upper dummy and lower dummy may be quickly kicked at high speeds without effecting the other dummy. In this manner, the person practicing martial arts is not limited in the speed at which he may kick at the dummies, except, of course, his own natural ability and speed. Since the dummies are completely independent, kicking or punching of one dummy will not move the other dummy so that the untouched dummy is always available for an alternating quick kick or punch. In this manner, the trainee may build up his speed, control, and endurance at his highest possible level.

Preferably, upper overhead frame portion 10 includes an upper frame member 20 and a lower support frame member 22 which extend outwardly in a cantilevered manner from a standard 24 formed along the vertical height of the upright stand. There is a cross brace 26 extending across the top of standard 24. There are a pair of angle braces 28, 30 extending from standard 24 to near the ends of top brace 26. Upper pivot joint assembly joint B includes a cylindrical housing 32 and the lower and the lower joint pivot assembly B' includes a cylindrical housing 32'.

Figure 3:
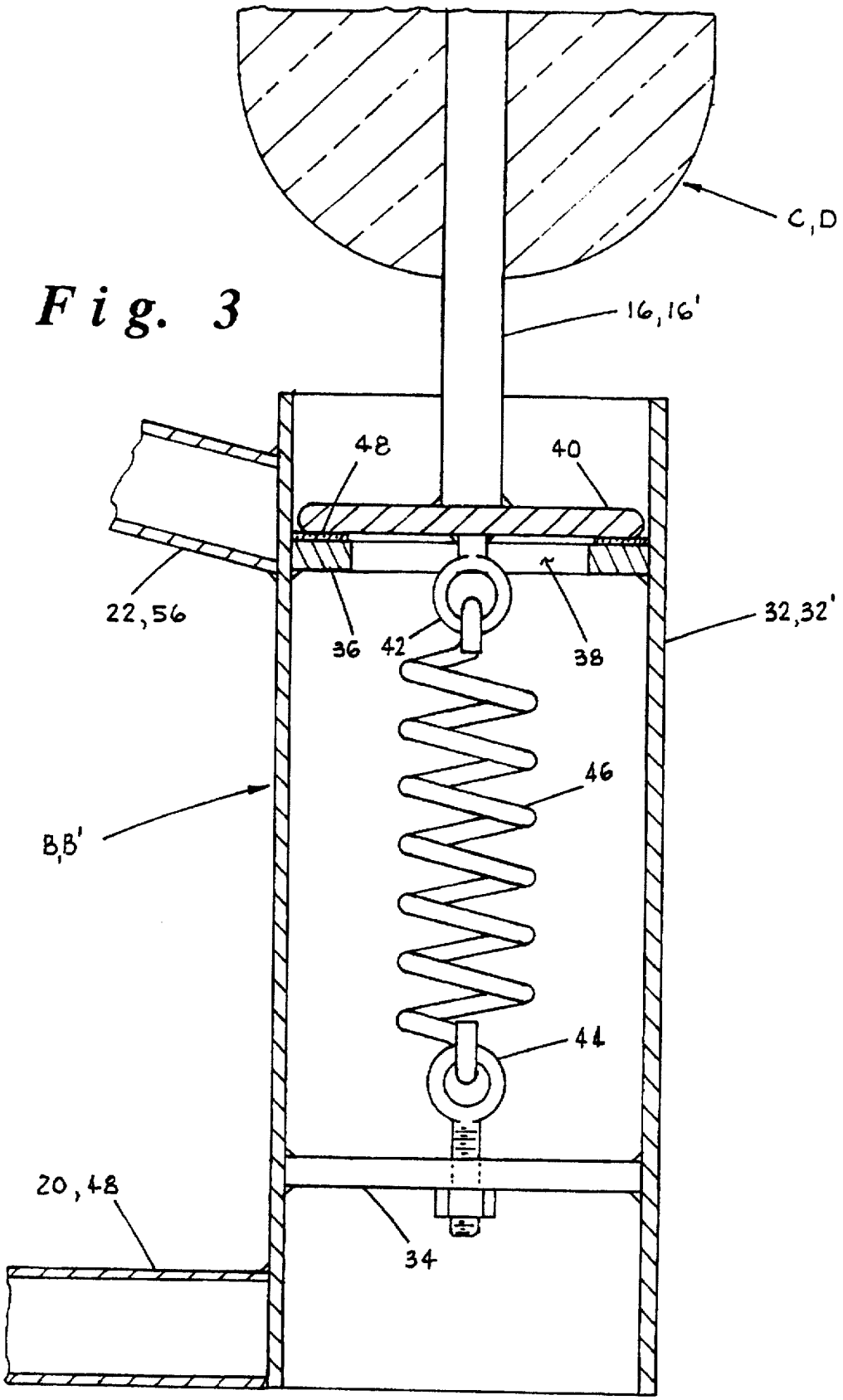
FIG. 3 is a cross-sectional view of a pivot joint assembly of the martial arts training apparatus of this invention.

Referring now to more details of the pivot assemblies B,B' of this embodiment, FIG. 3 illustrates a cross-sectional view of the lower joint B'. A stationary anchor bar 34 is affixed within housing 32 by any suitable means such as welding. Spaced above anchor bar 34 is a stationary support plate 36 having a central aperture 38. There is a round pivot plate 40 affixed to the end of core element 16' by any suitable means such as welding. It will be noted that pivot plate 40 and support plate 36 are round. There is a first connector 42 affixed to pivot plate 40 by any suitable means such as welding. There is a second connector 44 connected to anchor bar 34 by any suitable means such as a bolt arrangement as illustrated. There is a coil spring 46 connected between connectors 42 and 44 to provide a resilient connection between anchor bar 34 and pivot plate 40 which allows core element 16' and lower padded dummy D "omni-directional" movements; being rotational movements in any direction with respect to support plate 36. A felt pad 48 provides a padded interface between the support plate 36 and the pivot plate 40.

Preferably, upper pivot joint B is identical to lower pivot joint assembly B'. For that reason, a description of upper pivot joint assembly B will not be made, it being understood that the construction is the same as described in relation to lower pivot joint assembly B', above. In this case, core element 16 is affixed to pivot plate 40 of the upper pivot joint assembly B.

Figure 4:
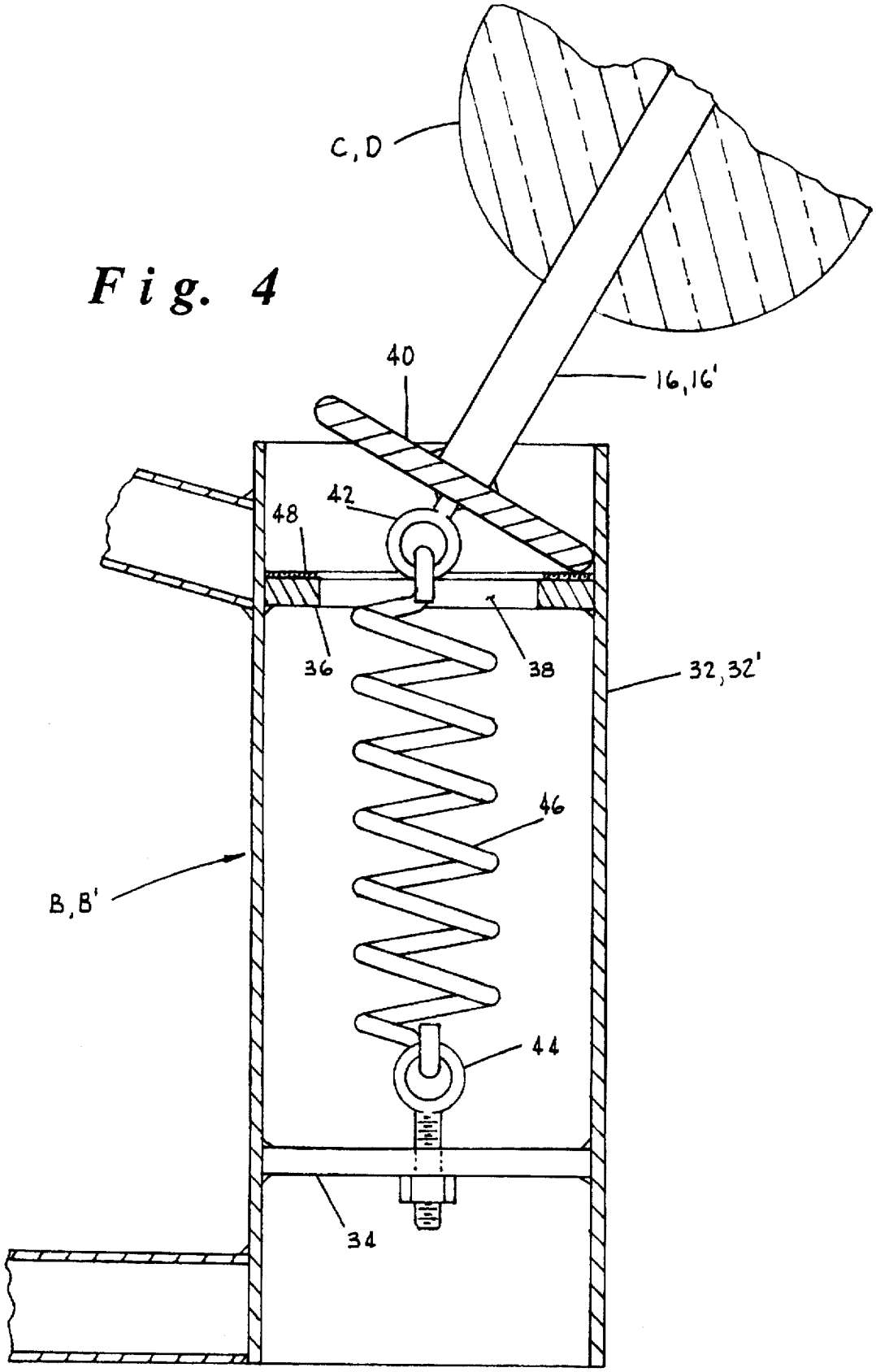
FIG. 4 is a cross-sectional view of the pivot joint assembly of FIG. 3 with a padded dummy having been moved by a person practicing martial arts according to the invention.

As can best be seen in FIG. 4, when lower dummy D is kicked or punched by a subject, pivot plate 40 is tilted or pivoted for omni-directional movement. Pivot plate 40 pivots or rotates with respect to the support plate 36 in the same direction as the dummy rotates when the subject kicks. For this purpose, the felt pad 48 overlays support plate 36 so that pivot plate 40 is padded in its pivot and roll movements on the support plate. In the same manner, upper padded dummy C is mounted for omni-directional movement to accommodate the direction of rapid and repeated kicks to the upper dummy as pivot plate 40 pivots and rolls about pivot support plate 36.

Again, referring to FIG. 1, it can be seen that lower base portion 12 includes a lower, outwardly extending frame member 48 and a cross frame leg 50, both of which are affixed to a lower portion of standard 24 by any suitable means such as welding. Angle bars 52, 54 connect an upper portion of standard 24 to the outer ends of cross-bar 50. Diagonal members 72, 74 may be added to help support and stabilize the apparatus A during the subject kicks and punches. If necessary, a frame member 56 may be included above frame member 48, both of which are affixed to a housing 32' of lower pivot joint assembly B'.

Figure 5:
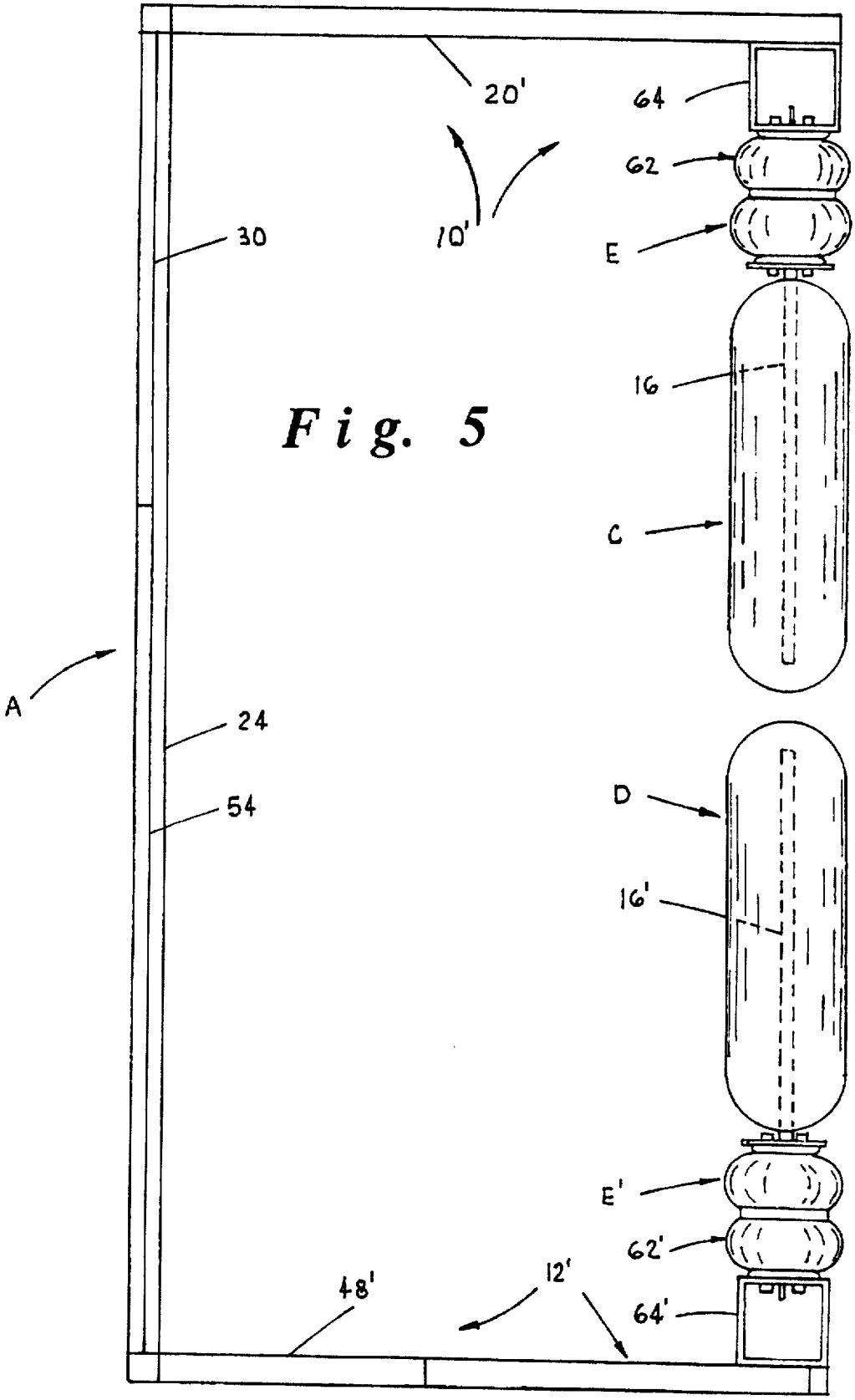
FIG. 5 is a side elevation view of a martial arts training apparatus having air bag springs according to this invention.

In an alternate embodiment of the present invention the pivot joint assemblies B and B' are replaced with air bag joint assemblies as illustrated in FIG. 5. An upper air bag join assembly E has an upper air bag housing 62 supported by upper bag support member 64 attached to a modified frame member 20' of the upper frame portion 10'. A lower air bag joint assembly E' has an lower air bag housing 62' supported by lower bag support member 64' attached to modified frame member 48' of the lower base portion 12'. The remaining portions of the assembly A are the same as previously described and omni-directional movement of dummies C and D are again independently achieved.

Figure 6:
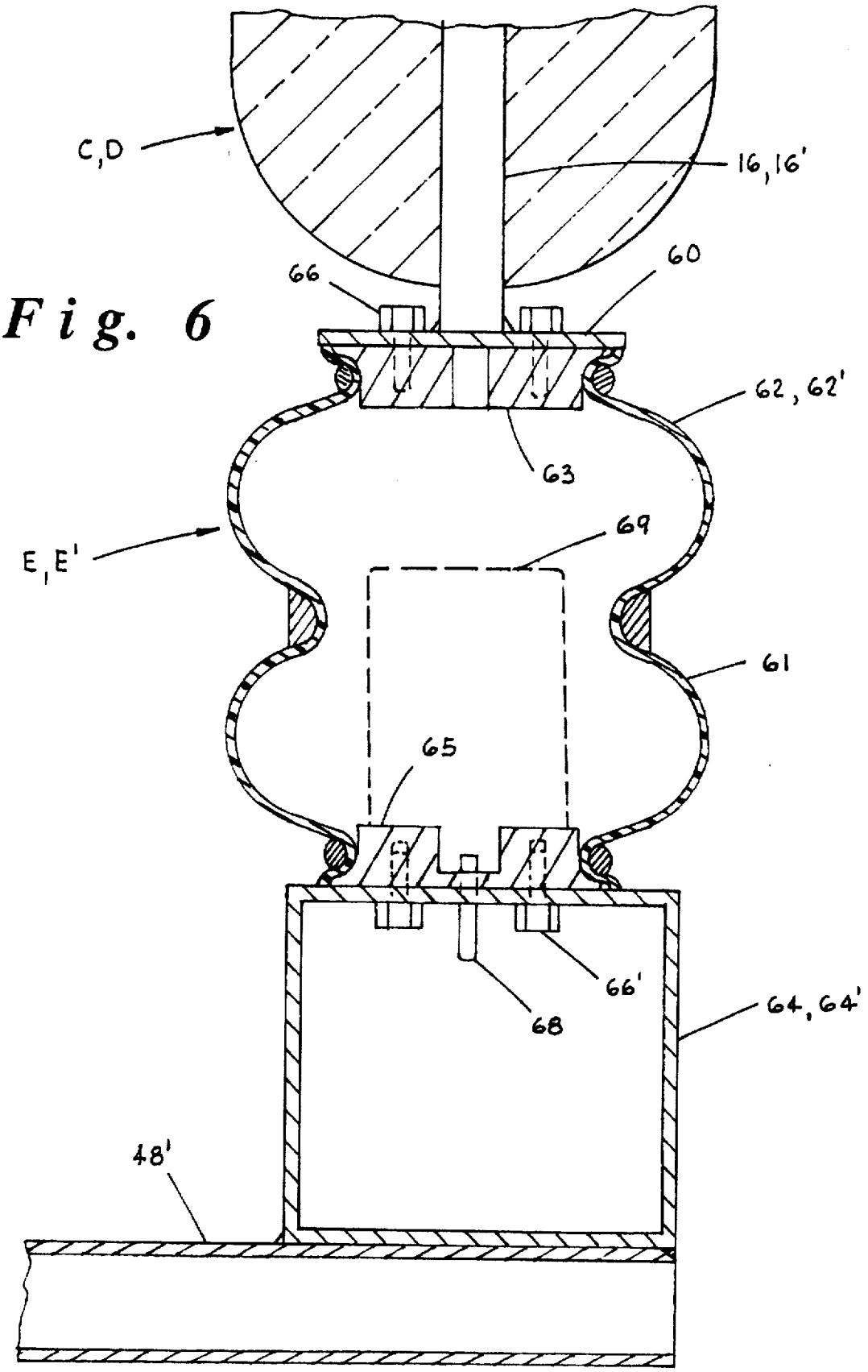
FIG. 6 is a cross-sectional view of an air bag spring assembly of the martial arts training apparatus of this invention.

Referring now in more detail to this embodiment of the air bag joint assemblies E and E', FIG. 6 illustrates a cross-sectional view of the lower air bag joint assembly E'. The lower air bag joint assembly includes an air bag housing 62' comprising a resilient air spring bellows 61 connected to an upper end diaphragm 63 and a lower end diaphragm 65. The lower end diaphragm 65 is affixed to lower bag support member 64' by any suitable means such as two bolts 66'. The upper end diaphragm 63 is carries an air bag pivot plate 60 affixed by any suitable means such as two bolts 66. The air bag pivot plate is affixed to the end core element 16' by any suitable means such as welding. Air bag pivot plate 60 allows rigid core element 16' and lower padded dummy D omni-directional movements in any direction. The amount of movement of padded dummy D is controlled by varying the air pressure within the resilient air spring bellows 61. An air valve 68 is provided in the lower end diaphragm to change the pressure within the air spring bellows. In general, the higher the air pressure in the bellows the stiffer the air gag housing becomes and the dummy D will have a smaller omni-directional movement when kicked or punched with the same force intensity. A pressure can be determined which will give a predetermined rotational stiffness of the air bag housing when the rigid core element is displaced. A bumper 69 can be provided inside the bellows to limit the minimum extent of the bellows due to a low pressure. A typical air bag housing 62, 62' is Airstroke® Actuator, Model No. 2B6-535 manufactured by Firestone of Akron, Ohio.

Preferably, upper air bag joint assembly E is identical to lower air bag joint assembly E'. For that reason, a detailed description of upper air bag joint assembly E will not be made, it being understood that the construction is the same as described in relation to lower air bag joint assembly E', above. In this case, core element 16 is affixed to air bag pivot plate 60 of the upper air bag joint assembly E, and the air bag pivot plate is affixed to the upper air bag housing 62. In the same manner, upper padded dummy C and lower padded dummy D are mounted for omni-directional movement to accommodate the direction of rapid and repeated kicks to the upper and lower dummies as air bag pivot plate 60 pivots and rolls.

Thus, it can be seen that an advantageous construction can be had for a training apparatus for martial arts and the like wherein independent upper and lower padded dummies are provided that may be kicked or punched at high speeds in an alternating and repetitive manner. For example, various combinations of round kicks, hook kicks, and side kicks can be made between the upper and lower dummies. The round kicks may go from lower to upper, upper to upper, lower to low, upper to low, or any other variations. The hook and side kicks may be done in the same manner. There is no limitation upon the training apparatus as far as the speed of the kicks. Since the upper and lower dummies are completely separated from each other, there is no need to hesitate between kicks in order for the bodies to rebound and become stationary; as in the case where dual punching bags have been tied together. Due to the unique pivot or air bag joint assembly, the same bag may be repetitively kicked or punched while in a tilted or pivoted position without any rebound effect as may occur from previous spring loaded punching bags and the like. The upright stand allows for the device to be moved around in the training room as opposed to other type devices which have to be affixed to the floor, wall, or other fixed locations.

While a preferred embodiment of the invention has been described using specific terms, such description is for illustrative purposes only, and it is to be understood that changes and variations may be made without departing from the spirit or scope of the following claims.

What is claimed is:

1. A training apparatus for the martial arts comprising:

an upright rigid stand having an upper overhead frame portion and a lower base frame portion which is supported on a floor surface;

an upper padded dummy carried by said overhead frame portion;

an upper, rigid elongated core connected to said upper padded dummy;

an upper pivot joint assembly carried by said overhead frame portion of said upright stand, and said upper elongated core being affixed to said upper pivot joint assembly providing omni-directional movement of said upper padded dummy relative to said overhead frame portion;

a lower padded dummy carried by said base frame portion of said upright stand;

a lower, rigid elongated core connected to said lower padded dummy;

a lower pivot joint assembly carried by said base frame portion of said stand, said lower core element being affixed to said lower pivot joint assembly providing omni-directional movement of said lower padded dummy relative to said base frame portion independent of said movement of said upper padded dummy; and said upper dummy and said lower dummy being in a substantial superposed alignment so as to be capable of being struck in various combinations of quick successive kicks and/or punches.

2. The apparatus of claim 1 wherein said upper joint assembly is a pivot joint assembly and includes a stationary anchor; a stationary support spaced from said stationary anchor; a round pivot plate affixed to said core element engaging said support; and a resilient connector connected between said pivot plate and said stationary anchor biasing said pivot plate against said support.

3. The apparatus of claim 2 wherein said stationary anchor comprises a stationary anchor bar; said stationary support comprises a stationary circular support plate having a central aperture; and said resilient connector extends through said central aperture to connect to said pivot plate.

4. The apparatus of claim 3 including a first connector connected to said pivot plate, a second connector connected to said stationary anchor bar, and said resilient connector comprising a coil spring connected between said first and second connectors.

5. The apparatus of claim 2 wherein said resilient connector comprises a spring connected between said pivot plate and said stationary anchor.

6. The apparatus of claim 2 wherein said lower joint assembly is a pivot joint assembly and includes a stationary anchor; a stationary support spaced from said stationary anchor; a round pivot plate affixed to said core element engaging said support; and a resilient connector connected between said pivot plate and said stationary anchor biasing said pivot plate against said support.

7. The apparatus of claim 6 wherein said stationary anchor comprises a stationary anchor bar; said stationary support comprises a stationary circular support plate having a central aperture; and said resilient connector comprises a spring extending through said central aperture to connect said stationary anchor to said pivot plate.

8. The apparatus of claim 1 wherein said stand includes a rigid, vertical standard extending between said overhead portion and said base portion, and said overhead frame portion comprises an outwardly extending frame member extending outwardly from said standard; and said upper joint assembly is carried by said upper frame member.

9. The apparatus of claim 8 wherein said lower base frame portion comprises a lower, outwardly extending frame member extending outwardly from said standard; and said lower joint assembly is carried by said lower frame member.

10. The apparatus of claim 1 wherein said upper and lower elongated cores are vertically aligned, and including a clearance space defined between a free end of said upper padded dummy and a free end of said lower padded dummy so that said upper and lower dummies move and respond completely independently of each other.

11. The apparatus of claim 1 wherein said core elements include rigid tubing affixed to said pivot plates which extend centrally into said respective upper and lower dummies, and said padding includes a generally resilient material surrounding said core elements affixed to said core elements forming a smooth exterior surface without projections.

12. The apparatus of claim 1 wherein each said upper and lower joint assembly is an air bag joint assembly and includes:

a bag support member carried by said upright rigid stand; and an air bag housing having a first end carried by said bag support member and a second end connected to said elongated core.

13. A training apparatus for the martial arts comprising:

an upright stand having an overhead, rigid cantilevered frame, a rigid base frame which is supported on a floor surface, and a rigid vertical standard extending between said rigid cantilevered frame and base frame;

an upper padded dummy having an upper elongated rigid core;

an upper pivot joint assembly carried by said overhead cantilevered frame;

said upper elongated core being carried by said upper pivot joint assembly for providing omni-directional movement of said upper padded dummy;

a lower padded dummy having a lower elongated core, and said lower padded dummy being vertically spaced and free from said upper padded dummy;

a lower pivot joint assembly carried by said base frame;

a lower elongated core being carried by said lower pivot joint assembly providing omni-directional movement of said lower padded dummy independent of said upper padded dummy; and said upper dummy and said lower dummy being in a substantial superposed alignment so as to be capable of being struck in various combinations of quick successive kicks and/or punches.

14. The apparatus of claim 13 wherein each said upper and lower joint assembly includes a pivot joint assembly having a stationary anchor; a stationary support spaced from said stationary anchor; a round pivot plate affixed to said core element engaging said support; and a resilient connector connected between said pivot plate and said stationary anchor biasing said pivot plate against said support.

15. The apparatus of claim 14 wherein said stationary anchor comprises a stationary anchor plate; said stationary support comprises a stationary support plate having a central aperture; and said resilient connector extends through said central aperture to connect to said round pivot plate.

16. The apparatus of claim 15 wherein said resilient connector comprises a spring connected between said pivot plate and said stationary anchor.

17. The apparatus of claim 16 including a clearance space defined between a free end of said upper padded dummy and a free end of said lower padded dummy so that free ends are completely detached from one another and said upper and lower dummies move and respond completely independently of each other.

18. The apparatus of claim 13, wherein each said upper and lower joint assembly includes:

an air bag joint assembly having a bag support member carried by said frame; and an air bag housing having a first end carried by said bag support member and a second end connected to said elongated core.

19. The apparatus of claim 18 wherein each air bag housing includes an upper end diaphragm, a lower end diaphragm affixed to said bag support member and a resilient air spring bellows connected between said upper end diaphragm and said lower end diaphragm, wherein said bellows is pressurized to provide a predetermined rotational stiffness of said air bag housing.

20. The apparatus of claim 19, wherein said air bag housing includes and an air valve for pressurizing said air bag housing so that said predetermined rotational stiffness of said air bag housing is provided when said rigid core is displaced.

21. The apparatus of claim 19 wherein said air bag joint assembly includes a bag pivot plate having one side carried by said upper end diaphragm and an opposite side which is affixed to said elongated core.

22. The apparatus of claim 19 including a clearance space defined between a free end of said upper padded dummy and a free end of said lower padded dummy so that free ends are completely detached from one another and said upper and lower dummies move and respond completely independently of each other.

23. A method of martial arts training comprising:

providing an upper padded dummy carried by a rigid frame in a manner that said upper dummy moves in omni-directional movements;

providing a vertically aligned lower padded dummy carried by said rigid frame below said upper dummy for omni-directional movement independent of said upper dummy; and striking said upper and lower dummies in a desired sequence to develop speed and coordination.

24. The method of claim 21 including supporting said upper and lower dummies for omni-directional movement about independent joint assemblies where free ends of said upper and lower dummies are completely detached.

* * * * *